US007841460B2

(12) United States Patent
Streibig et al.

(10) Patent No.: US 7,841,460 B2
(45) Date of Patent: Nov. 30, 2010

(54) ESCALATOR WITH NOVEL EMERGENCY GUIDE MEANS

(75) Inventors: Kurt Streibig, Rekawinkel (AT); Thomas Illedits, Neufeld (AT); Thomas Novacek, Schwechat (AT)

(73) Assignee: Inventio AG, Hergiswil (CH)

( * ) Notice: Subject to any disclaimer, the term of this patent is extended or adjusted under 35 U.S.C. 154(b) by 239 days.

(21) Appl. No.: 11/713,179

(22) Filed: Mar. 2, 2007

(65) Prior Publication Data

US 2007/0205080 A1 Sep. 6, 2007

(30) Foreign Application Priority Data

Mar. 3, 2006 (EP) ..... 06110647

(51) Int. Cl.
*B66B 21/00* (2006.01)

(52) U.S. Cl. ..... 198/333; 198/327

(58) Field of Classification Search ..... 198/321, 198/333, 327

See application file for complete search history.

(56) References Cited

U.S. PATENT DOCUMENTS 5,161,668 A * 11/1992 Datema et al. ..... 198/332
5,337,879 A * 8/1994 Fischer ..... 198/333
5,890,578 A 4/1999 Kwon et al.
6,405,848 B1 6/2002 Babler
6,450,316 B1 * 9/2002 Stuffel et al. ..... 198/326
6,471,034 B2 * 10/2002 Lunardi et al. ..... 198/333
6,868,956 B2 * 3/2005 Hauer et al. ..... 198/333
2005/0279610 A1 12/2005 Ossendorf

FOREIGN PATENT DOCUMENTS

EP 1 234 797 A2 8/2002

* cited by examiner

*Primary Examiner*—Gene Crawford
*Assistant Examiner*—Kavel P Singh
(74) *Attorney, Agent, or Firm*—Ladas & Parry LLP

(57) ABSTRACT

An escalator with an endless formation of successive steps, each having a step surface, a front surface or step-riser and each side, a sideways directed cheek. Provided in the area of each cheek is at least one roller that projects transversely sideways, and is guided along laterally mounted, diagonally running roller-rails of the escalator. On each step in the area of the front surface or step-riser at least one emergency guide hook is fastened in such manner that the emergency guide hook of a higher lying upper first step supports itself against an area of the cheek of the next lower lying second step, should the step be eccentrically loaded in the area of the step-tread.

8 Claims, 4 Drawing Sheets

ESCALATOR WITH NOVEL EMERGENCY GUIDE MEANS

The invention relates to an escalator with an endless formation of successive steps.

BACKGROUND OF THE INVENTION

Escalators, sometimes also referred to as moving stairways, have an endless chain of successive steps that can transport people or items of luggage upwards and/or downwards. Present on the steps are rollers that are aligned with the sides and run on rails. By means of guide rails, the steps are brought into the desired position. Furthermore, the rollers and guide rails together serve to absorb vertically directed forces as, for example, when a step is stood on.

To prevent an individual step from tipping when it is, for example, eccentrically loaded, escalators typically have emergency guide systems. The emergency guide systems require various parts that must be manufactured and fastened. Furthermore, the manufacture of the emergency guide requires relatively high outlay.

The objective of the present invention is to provide a novel escalator that avoids the disadvantages of the state of the art and dispenses with the emergency guide systems that were formerly required: Above all, it should reduce the outlay for installation and assembly.

BRIEF DESCRIPTION OF THE INVENTION

The objective is fulfilled by the present invention in which, according to the invention, an emergency guide hook is attached in the area of the front surface or step-riser of a step in such manner that the emergency guide hook of the step supports itself against a part of a cheek of the next lower lying step, should the step be eccentrically loaded in the area of the step-tread. In other words, each step is provided with an emergency guide hook that is arranged in such manner that the steps mutually support each other should an eccentric load occur.

An advantage of this invention is that installation is much easier than for a conventional emergency guide system, since the emergency guide hooks can already be pre-installed on the step before assembly of the step chain. Thus, no elaborate installation and assembly of the individual elements of the emergency guide system is required as was the case in escalators hitherto. Alternatively, the emergency guide hooks can also be cast or formed integral with the steps.

Furthermore, the emergency guide hook itself is inexpensive to manufacture, especially when produced as a stamping out of sheet metal.

In a currently preferred embodiment of the invention, the emergency guide hook sits directly on the axle of one of the rollers that is present on the step. This simplifies assembly.

BRIEF DESCRIPTION OF THE DRAWINGS

Further details and advantages of the invention are explained below in relation to exemplary embodiments and by reference to the annexed drawings, wherein.

DETAILED DESCRIPTION OF THE INVENTION

Figure 1:
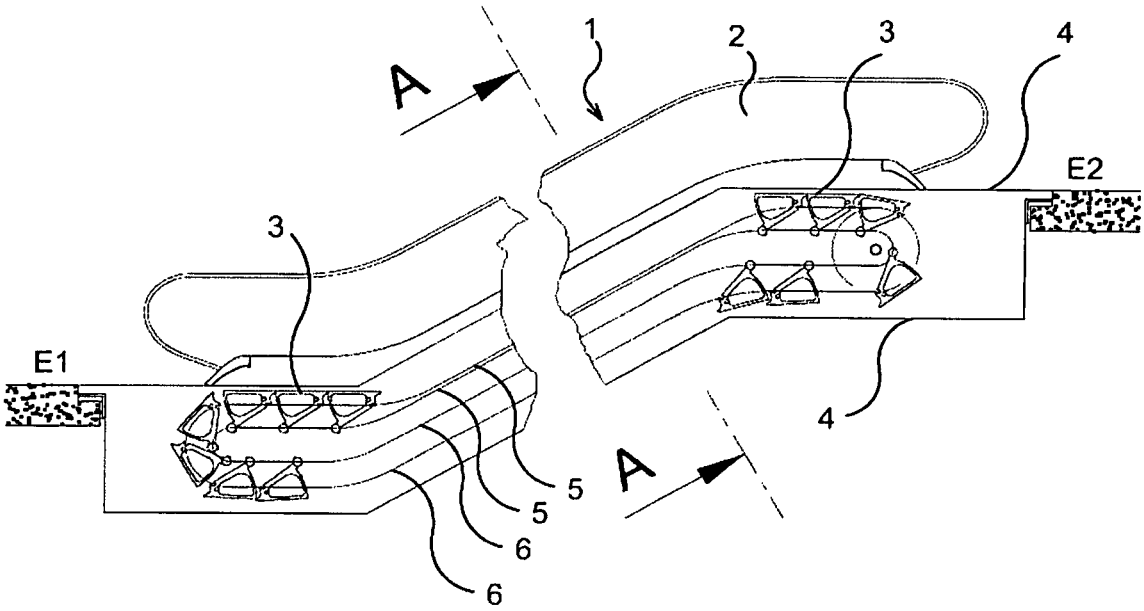
FIG. 1 is a diagrammatic side view, partly cut away, of an escalator with which a device according to the invention can be used.

FIG. 1 shows a conventional escalator 1 that connects a lower level E1 with an upper level E2. The escalator has an endless formation of successive steps 3 that are, however, only partly shown in FIG. 1. As lateral boundaries in the lower portion, the escalator 1 has, as usual, skirt-panels 2.1 (see FIG. 3) and in its upper portion a locationally fixed balustrade 2, generally arranged at the top of which is a handrail 2.2 that is movable with the endless formation of steps 3. Typically provided on escalators 1 of this type are transporting guides 5 and return guides 6.1, 6.2.

Figure 2:
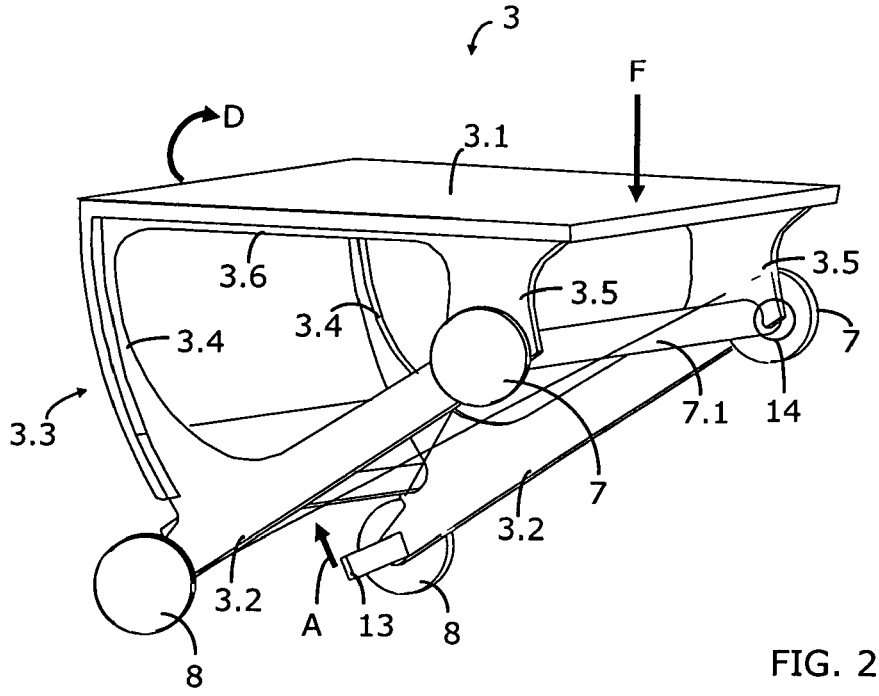
FIG. 2 is a perspective view of a step of an escalator according to the invention, a first embodiment of an emergency guide hook according to the invention being fastened on the step.

Each step 3 has a step-tread 3.1, a front surface or step-riser 3.3, and on each side a sideways directed cheek 3.4. Shown in FIG. 2 is a step 3 according to the invention. In this figure, one of the side cheeks lies quasi in the plane of the drawing. The second side cheek 3.4 is only visible from the inside of the step. Provided in the area of each cheek are two transporting rollers 7 and 8 that project sideways, and that are guided and supported along the laterally mounted, diagonally roller-rails 5, 6.1, 6.2 of the escalator 1.

To prevent an individual step 3 from tipping when it is, for example, eccentrically loaded by a load on the step-tread 3.1, conventional escalators 1 typically have two emergency guide rails 9. Installation of the emergency guide is relatively elaborate, and the emergency guide requires numerous different parts 9, 10, 11, 12 that must be manufactured and delivered.

Figure 3:
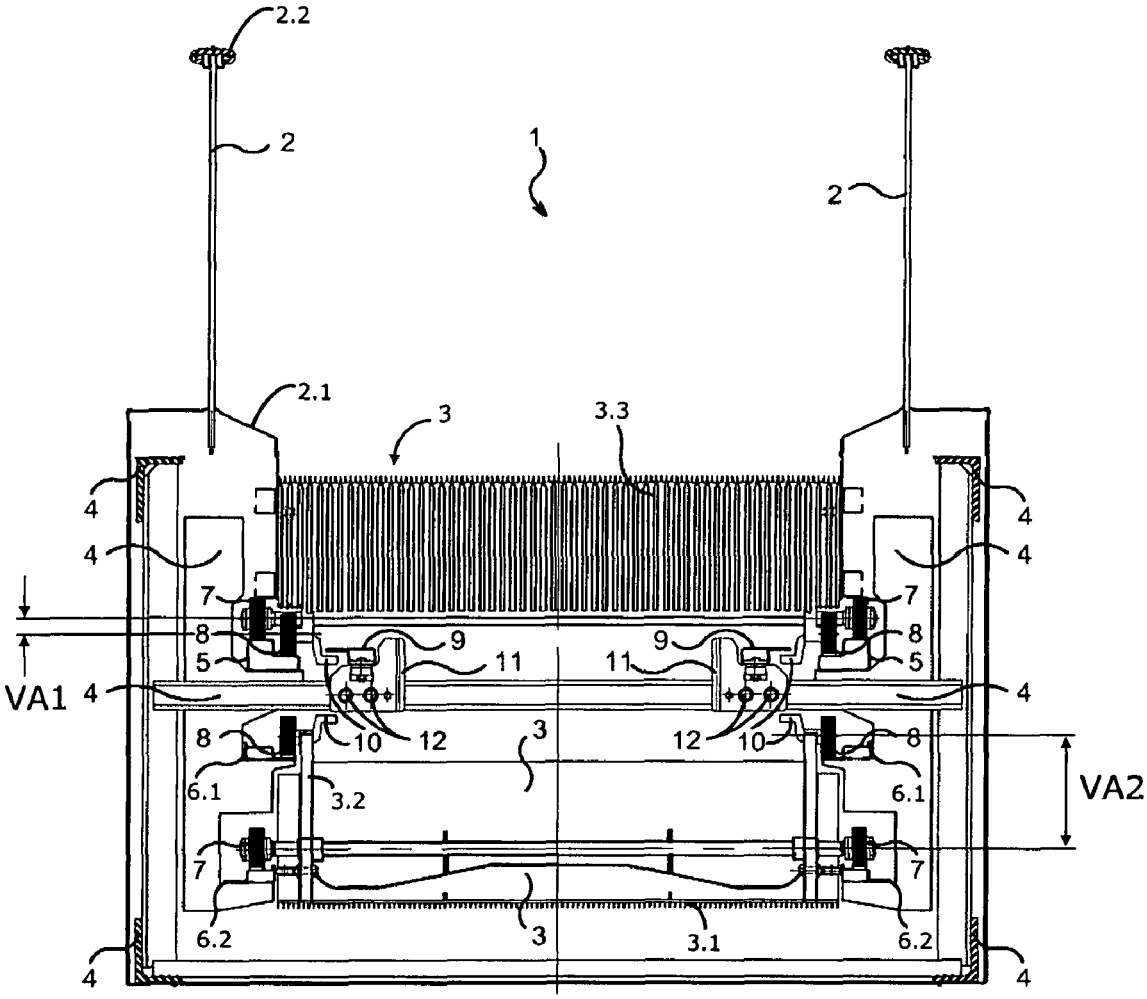
FIG. 3 is a cross-section view taken along line A-A of FIG. 7, of a step of an escalator with a conventional guide system.

Shown in FIG. 3 is a cross section through a conventional escalator 1 perpendicular to the direction of travel. By reference to this figure it will be briefly explained how the emergency guide that is usual today is constructed. In addition, other elements of the escalator 1 are described that are also present in an escalator 1 according to the present invention.

The escalator 1 is borne in a truss whose various elements are indicated in FIG. 3 with reference number 4. Fastened on this truss 4 are the transporting rails 5 and return rails 6 (6.1, 6.2) return rails that were mentioned at the outset. It can be seen from FIG. 3 that the transporting guides 5 have an L-shaped cross section and thereby define two different running planes. On the upper running level run the outer rollers 7, i.e. the rollers 7 with a large wheel separation, and on the lower running level run the inner rollers 8, i.e. the rollers 8 with a smaller wheel separation. The rollers 7 and 8 are shown black in FIG. 3, to highlight them. The transporting rails 5 serve as vertical supports for the steps 3 and absorb vertically directed forces, as well as guiding the steps 3 upwards or downwards on the truss 4 (depending on the direction of movement). In the diagonal area of the escalator 1, the vertical distance between the upper running level and lower running level of the escalator 1 is chosen relatively small so that the steps 3 are turned or swiveled into the normal position and guided stably. In the normal position, the vertical axis distance VA1 between the outer rollers 7 and the inner rollers 8 is small, as outlined on the left side of FIG. 3.

The respective rollers 7, 8 on each side of a step 3 are arranged mutually offset so as to be able to guide the steps 3 stably along the diagonally running roller-rails 5, 6.

The return rails 6 have an upper running level 6.1 and a lower running level 6.2. The distance between these running levels 6.1 and 6.2 is very much greater than the vertical axis distance VA1 and the steps 3 are transported back in the so-called return area (see FIG. 1) hanging, i.e. with the step-tread 3.1 facing down. In the return area of the return side, the vertical axle distance VA2 between the outer rollers 7 and the inner rollers 8 is very much greater than the vertical axle distance VA1 on the transporting side, as indicated on the right-hand side of FIG. 3.

The elements described hitherto in association with FIG. 3 are also present in a currently preferred embodiment of the invention.

The elements of the emergency guide that is usual today will now be briefly described. Two emergency guide rails 9 are present and are mounted on the truss 4 with fastening brackets 11 and associated fastening bolts 12, fastening nuts and screw-locking devices. Fastened on the step body 3 or step web 3.2 in the area of the rollers 8 is a hook 10. Viewed from the side cheek of the step 3, this hook 10 faces inward. In the installed state, the hooks 10 engage under the emergency guide rails 9 and normally run there without contact with the guide rails 9. Should an eccentric loading of a step 3 occur, the step tilts slightly about a horizontal axis or step axis respectively, and on one or other side of the emergency guide rails 9, a hook touches an emergency guide rail 9. Vertically upwards directed tipping movements are thereby stopped. But troublesome rubbing or resting or supporting occurs in the contact area, since the hook 10 slides along the emergency guide rail 9. This causes rubbing, and under certain circumstances sounds, that are undesirable.

The essential elements of the invention are now explained by reference to FIG. 2, to the extent they were not already described.

Each step 3 has a step body or step corpus that is designed to lend stability to the step 3 and carries various elements or connects them together. Connected to the step body are the step surface 3.1 and the front surface or step-riser 3.3. In the embodiment of the invention that is shown, the step body contains two side cheeks 3.4 that are formed by a sort of open frame. In the lower area, the open frame has an elongated step-web 3.2. As shown in the drawing, front struts 3.4 and back struts 3.5 start from the step-web 3.2 and run upwards. These struts 3.4, 3.5 are in turn connected with webs 3.6 on which the step surface 3.1 rests. In the back area of the step body, the two cheeks are connected by the wheel axle or by a step axle 7.1. In the front area of the step body, the front surface or step-riser 3.3 runs between the cheeks 3.4. The step-web 3.2 extends essentially parallel to a direction that is defined by the diagonally running roller-rails (5) when the respective step (3) is in a transporting-side area of the escalator (1). The deviation can be ±10 degrees.

According to the invention, fastened at least in the area of one of the cheeks is an emergency guide hook 13 which, in the example shown, projects inward essentially perpendicular to the plane defined by the cheek. If the step 3 is now loaded eccentrically (as outlined by the arrow F), this results in a tipping movement of the step 3 that is represented by the curved arrow D. In this case, the emergency guide hook 13 moves slightly upward and forwards, as shown diagrammatically by the arrow A.

If the endless formation of successive steps 3 is now considered, it will be seen that in case of "emergency", the emergency guide hook 13 contacts the back end of the step-web 3.2 of the next step 3 that is positioned somewhat below the eccentrically loaded first step 3. In FIG. 2, the area 14 on step 3 is indicated by a circle within which contact would occur if the emergency guide hook 13 of an upper first step 3 (not shown) were deployed.

Figure 4:
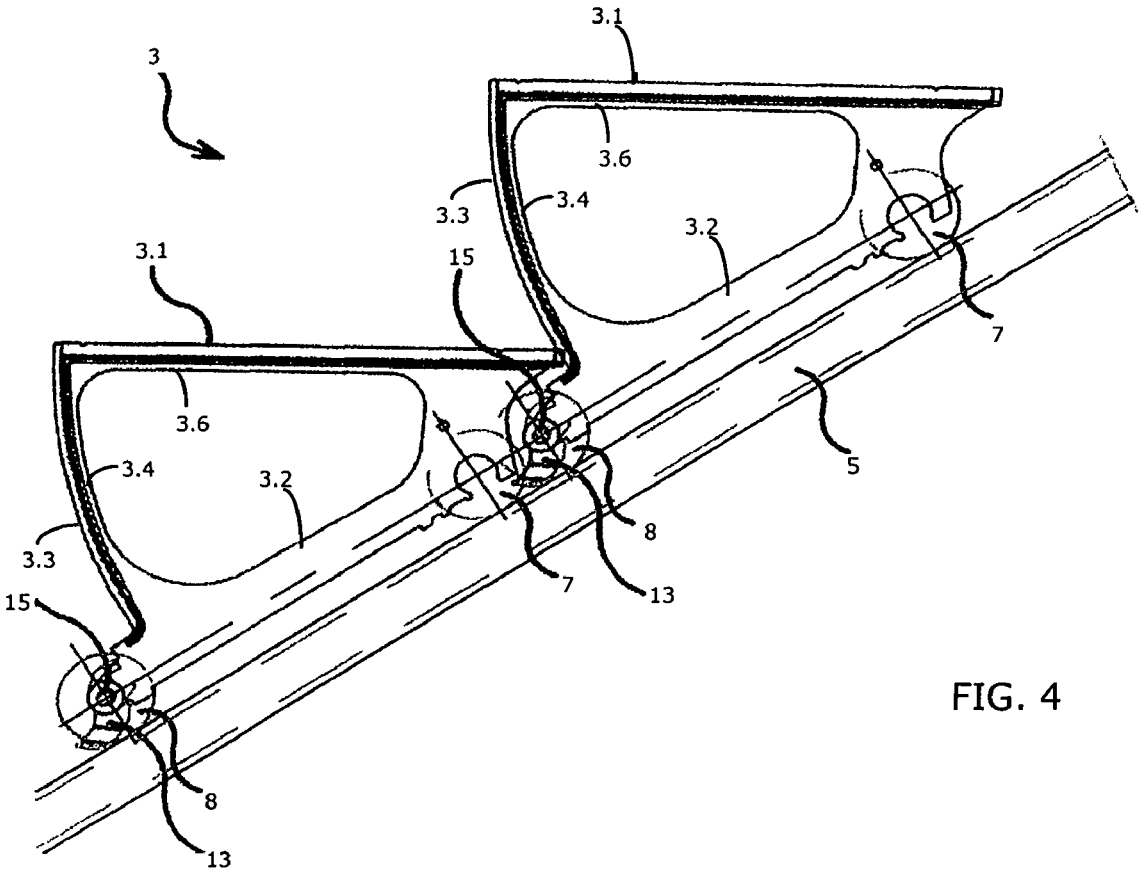
FIG. 4 is a side elevation view of two successive steps of an escalator according to the invention, there being fastened on each step a second embodiment of an emergency guide hook according to the invention.

Shown in a diagrammatic side view in FIG. 4 are details of a further embodiment according to the invention. Shown in this FIG. 4 is the diagonally running transporting-side rails 5, and two successive steps 3 can be seen. The rollers 7 run on upper running levels in the roller-rail 5 as described. The same reference numbers are used as in the previous figures. An explanation of the elements that have already been described is therefore unnecessary.

Figure 5:
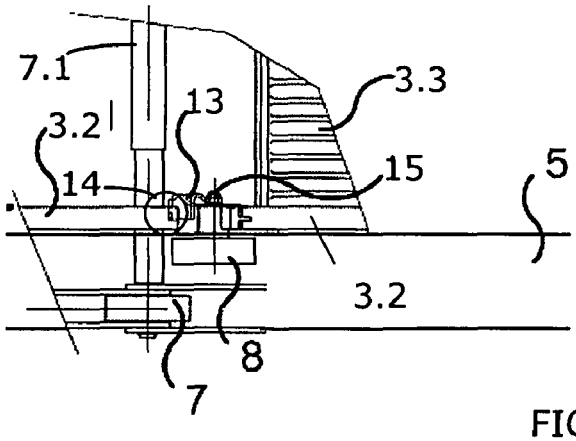
FIG. 5 is an enlarged plan view of the area between the two steps as shown in FIG. 4.

Shown in FIG. 4 is a further embodiment of the emergency guide hook 13. The emergency guide hook 13 sits in an extension of the axle of the roller 8 and is arranged inside and directed in the transverse direction (as viewed from the cheek). By means of a nut 15 and an optional screw-locking device, the emergency guide hook 13 is fastened to the stub of the middle axle of the roller 8 on the inside of the cheek or of the step web 3.2 respectively. Details thereof are to be seen in FIG. 5. This figure contains an enlarged plan view of the area between two subsequent steps 3. FIG. 5 shows that the emergency guide hook 13 can be, for example, a part that is stamped out of sheet metal and bent and that rests with a vertical surface against the step-web 3.2. This vertical surface has a hole or a slit to make it possible to bolt or fasten the emergency guide hook 13 to the axle of the roller 8. The emergency guide hook 13 also has a contact area that is designed to enter into interplay with the step body or step-web 3.2 of the next step 3 should eccentric loading occur. As shown in FIG. 5, this contact area can have a surface area (horizontal surface) that lies perpendicular to the vertical surface. The contact area can, however, also have a differently aligned surface. In case of emergency, the described interplay or resting against and supporting between two adjacent steps 3 occurs in the area 14 that is indicated by a circle. This interplay causes the eccentrically loaded front first step 3 to support itself by its emergency guide hook 13 against the step body or step-web 3.2 of the adjacent back step 3 and thereby stop or prevent tipping of the front first step 3.

Figure 6:
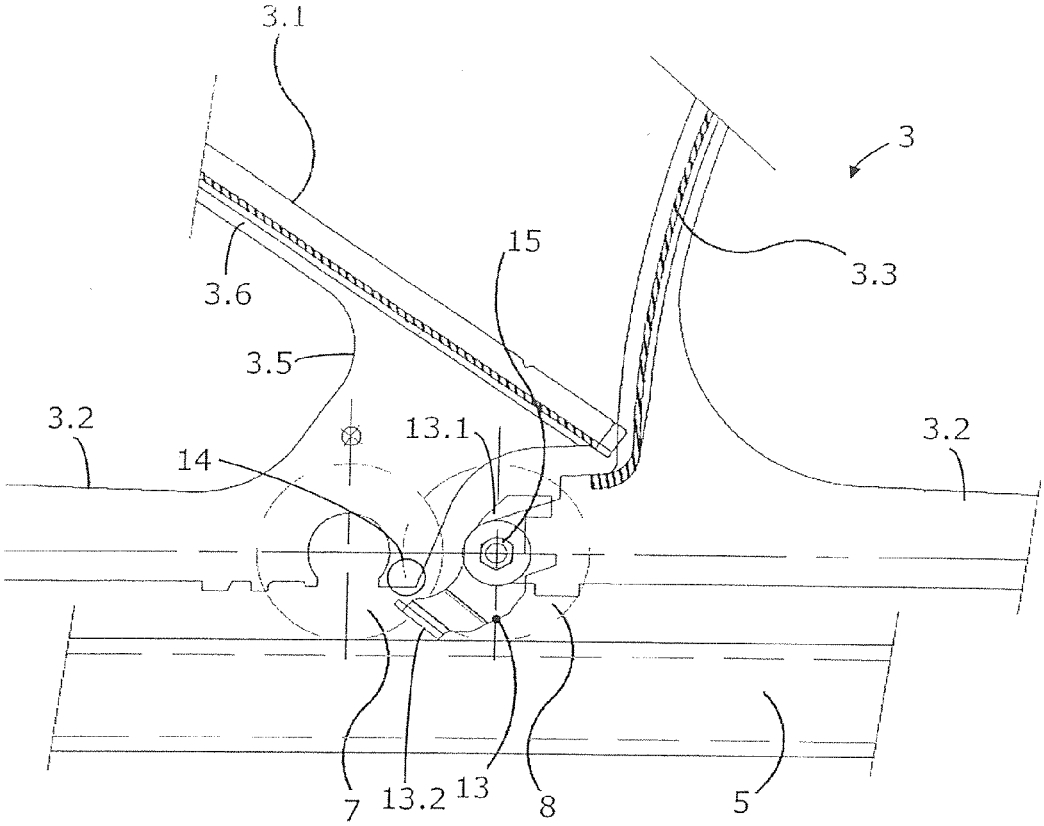
FIG. 6 is an enlarged cross-section elevation view of the area between the two steps shown in FIG. 4.

Further details are to be seen in the enlarged cross-section of FIG. 6. Visible in FIG. 6 is the opposite cheek seen from within. As opposed to FIG. 4, the figure is not shown diagonally. In other words, the figure is turned so that the transporting-side rail 5 runs horizontally. The rollers 7 and 8 are only shown in outline. By means of the nut 15 and an optional screw-locking device 16, the emergency guide hook 13 is fastened on the axle of the roller 8 on the visible inside of the cheek or of the step-web 3.2. The vertical area 13.1 of the emergency guide hook 13 now lies in the plane of the drawing. In the exemplary embodiment shown, the contact area or surface area 13.2 is positioned diagonally and projects vertically from the plane of the drawing, i.e. the contact area 13.2 faces from this cheek toward the inside of the step. In case of emergency, mechanical interplay with the next step 3 occurs in the area 14 that is indicated by a circle.

Figure 7:
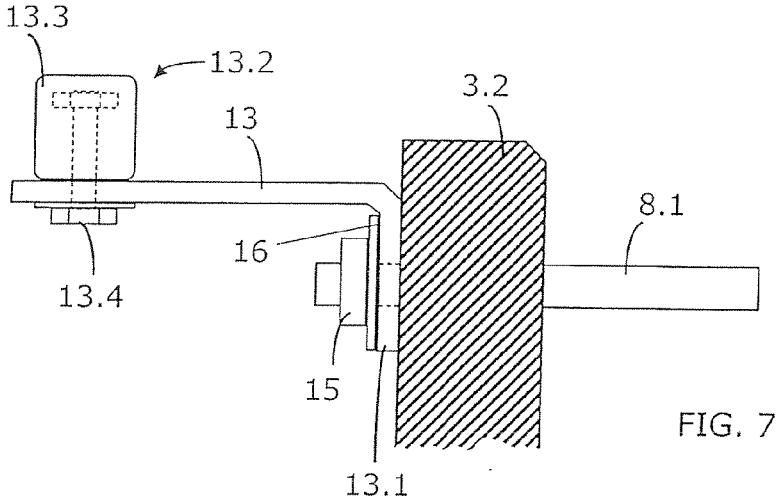
FIG. 7 is an enlarged cross-section of a further emergency hook according to the invention in an installed state.

Shown in FIG. 7 is yet a further embodiment of an emergency guide hook 13 according to the invention. The emergency guide hook 13 sits on the extension of the axle or the middle portion of axle 8.1 of the roller 8 (the roller 8 is not shown) and is aligned transversely (as viewed from the step web 3.2). By means of a nut 15 and an optional screw-locking device 16, the emergency guide hook 13 is fastened to the axle of the roller 8 on the inside of the cheek or of the step-web 3.2. In other words, the vertical portion 13.1 of the emergency guide hook 13 rests flat against the step-web 3.2. In the example shown, the contact area 13.2 is executed differently. Sitting in this area 13.2 is a buffer element 13.3 (of, for example, rubber, nylon or plastic, PA, PU, or POM). This element can be bolted to the emergency guide hook 13 by means of, for example, a hexagonal bolt and nut 13.4.

This embodiment has the advantage that the interplay is damped. A suitable choice or hardness of the buffer element 13.3 allows the damping to be set. Instead of working with a solid buffer element 13.3, a spring buffer element can be correspondingly used. Embodiments with a solid or spring buffer element 13.3 have the advantage that in normal operation they prevent the steps 3 or step band from swinging upwards or oscillating. It is also possible to attach a buffer or spring element to the respective adjacent step 3 so that the emergency guide hook 13 does not strike a metal surface and, for example, cause noises.

It is regarded as an important advantage of the emergency-guide-rail-free embodiment that no noises occur. Installation is also much easier and less expensive than installation of conventional emergency guide systems.

We claim:

1. An escalator with an endless formation of successive steps, each step having a step-tread, a front-surface or step-riser, and a sideways facing cheek on opposed sides, there being provided in the area of each cheek at least one sideways projecting roller that is guided along roller-rails of the escalator that run diagonally, characterized in that in each step has, in the area of the front-surface or step-riser, an emergency guide hook fastened in such manner that the emergency guide hook of each step rests directly against an area of a next lower lying step to retain the first step from shifting as a result of an eccentric load in the area of the step-tread and has a contact area positioned to be contacted by an emergency guide hook of a next higher lying step.

2. The escalator according to claim 1, characterized in that the sideways directed cheeks of a step lie essentially perpendicular to a plane that is formed by the step step-tread, and that each cheek contains a step-web that extends essentially parallel to a direction of a length of the diagonally running guide rails when the step is on a transporting-side area of the escalator.

3. The escalator according to claim 2, characterized in that each step has at least one emergency guide hook fastened in the area of one of the step-webs.

4. The escalator according to claim 2, characterized in that the emergency guide hook of a first step is adapted and positioned to engage the step-web of the next lower lying step it in order to support itself.

5. The escalator according to claim 1, 2, 3 or 4, characterized in that the emergency guide hook is sheet metal part formed by at least one of stamping and bending.

6. The escalator according to claim 1, 2, 3 or 4, characterized in that the emergency guide hook has a vertical area for attachment to the step and a contact area for support on the next lower lying step.

7. The escalator according to claim 1, 2, 3 or 4, characterized in that the emergency guide hook is adapted and constructed to be fastened to an axle of one of the rollers.

8. The escalator according to claim 1, 2, 3 or 4, characterized in that the emergency guide hook has a buffer element or spring element constructed and adapted to support itself against the next lower lying step on the occurrence of eccentric loading and/or oscillations of the step.

* * * * *